US005093544A

United States Patent [19]

Lesslie et al.

[11] Patent Number: 5,093,544

[45] Date of Patent: Mar. 3, 1992

[54] MOLDED CASE CIRCUIT BREAKER MOVABLE CONTACT ARM MOUNTING ARRANGEMENT

[75] Inventors: David J. Lesslie; Dennis J. Doughty, both of Plainville; Michael C. Guerrette, Plymouth, all of Conn.

[73] Assignee: General Electric Company, New York, N.Y.

[21] Appl. No.: 642,934

[22] Filed: Jan. 18, 1991

[51] Int. Cl.[5] ..... H01H 9/02

[52] U.S. Cl. ..... 200/244; 200/401; 29/622

[58] Field of Search ..... 200/401, 244, 144 R; 29/622

[56] References Cited

U.S. PATENT DOCUMENTS

| | | | |
|---|---|---|---|
| 4,086,460 | 4/1978 | Gillette | 200/146 R |
| 4,230,919 | 10/1980 | Schantz et al. | 200/244 X |
| 4,245,203 | 1/1981 | Wafer et al. | 335/16 |
| 4,573,259 | 3/1986 | Seymour et al. | 29/622 X |
| 4,637,131 | 1/1987 | Ochsner | 29/622 |
| 4,731,921 | 3/1988 | Ciarcia et al. | 29/622 |
| 4,733,033 | 3/1988 | Morris et al. | 200/401 |
| 4,965,418 | 10/1990 | Arnold et al. | 200/144 R |

OTHER PUBLICATIONS

Ser. No. 330,521 entitled "Molded Case Circuit Breaker Movable Contact Arm Arrangement", filed 3/30/89, Seymour et al.

*Primary Examiner*—Renee S. Luebke

*Attorney, Agent, or Firm*—Richard A. Menelly; Fred Jacob

[57] ABSTRACT

A molded case circuit breaker having a pair of movable contact arms arranged within each pole of a multi-pole arrangement utilizes a shunt clip between the movable contact arms to insure electrical continuity between the contact arms and the contact arm support base. The movable contact arms and the support base are both accurately positioned within the circuit breaker case by means of an interference-fit between the outside edges of the support base and the interior sidewall surfaces of the circuit breaker case.

6 Claims, 3 Drawing Sheets

MOLDED CASE CIRCUIT BREAKER MOVABLE CONTACT ARM MOUNTING ARRANGEMENT

BACKGROUND OF THE INVENTION

Current limiting circuit interruption devices such as molded case circuit breakers, generally employ a movable contact arm which is electrodynamically repulsed upon the occurrence of a short circuit overcurrent condition to drive the attached movable contact away from the fixed contact and rapidly disconnect the protected circuit. The same movable contact arm cooperates with an operating mechanism to separate the movable contact upon occurrence of overcurrent conditions less than short circuit intensity. In most current limiting circuit breaker designs, a flexible braid conductor is attached both to the movable contact arm and to the load terminal strap to insure good electrical continuity between the movable contact arm and the load terminal strap during such intense short circuit interruption.

U.S. Pat. No. 4,733,033, which Patent is incorporated herein for reference purposes, describes one such current limiting circuit breaker that utilizes a spring-clip contact arm retainer to insure good electrical continuity between the movable contact arm and the associated support structure.

U.S. Pat. No. 4,245,203 describes a movable contact arm arrangement wherein the contact arm support posts are bifurcated. The current paths through the bifurcated support posts generate complementary magnetic fields which, in turn, drive the support posts into good electrical connection with the movable contact arm pivot during intense short circuit conditions.

U.S. Pat. application Ser. No. 330,521, filed Mar. 30, 1989, now U.S. Pat. No. 5,004,878, entitled "Molded Case Circuit Breaker Movable Contact Arm Arrangement" describes a movable contact arm arrangement employing contact springs to increase the tension between the fixed and movable contacts under quiescent current operating conditions while contributing to prevent contact arm rebound during overcurrent conditions. This application is incorporated herein for purposes of reference and should be reviewed as indicative of the advanced state of the art of current limiting contact arm assemblies.

When the movable contact arm and the movable contact arm support base described within aforementioned U.S. Pat. No. 5,004,878 are attached to the circuit breaker case, it is important to maintain close tolerances between the sidewall surfaces of the circuit breaker case and the edges of the movable contact arms to insure maximum tension between the fixed and movable contacts and hence decrease the operating temperatures of the contacts during long periods of continuous operation under quiescent operating conditions.

One purpose of the invention accordingly, is to provide automatic means for accurately positioning the movable contact arm and movable contact arm support base within the circuit breaker case while at the same time compensating for any manufacturing tolerances that are accumulated between the contact arm support base and the circuit breaker case.

SUMMARY OF THE INVENTION

The invention comprises a current limiting circuit breaker movable contact arm assembly wherein a single U-shaped load strap forms one part of a hinged joint connection with a pair of independently rotatable movable contact arms. A shunt clip attached to the load strap interfaces with the movable contact arms to provide an electrical shunt path during intense short circuit conditions. A pair of plastic posts formed inboard the sidewalls of the circuit breaker case receive the movable contact arms and load strap in an interference-fit relation to automatically compensate for the manufacturing tolerances that are accumulated between the contact arms, the load straps and the circuit breaker case.

DESCRIPTION OF THE PREFERRED EMBODIMENT

Figure 1:
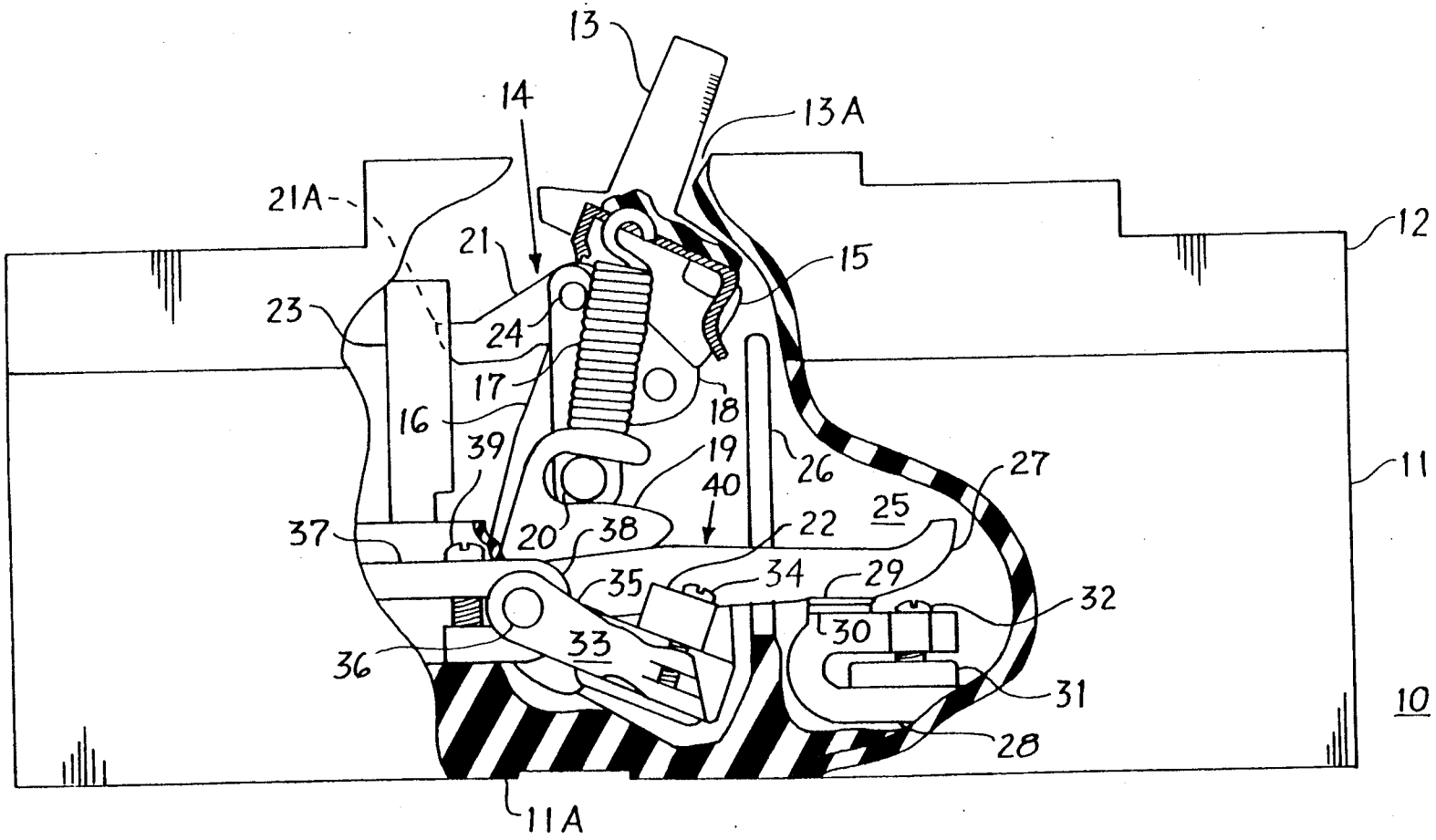
FIG. 1 is a cutaway side view of a current limiting circuit breaker employing the movable contact arm mounting arrangement according to the invention.

A current limiting circuit breaker 10 of the kind employing a molded plastic case 11 to which a molded plastic cover 12 is attached is depicted in FIG. 1. The circuit breaker includes an operating handle 13 that extends through a slot 13A formed within the cover and which manually overrides the circuit breaker operating mechanism shown generally at 14. The operating handle interfaces with the operating mechanism by means of the handle yoke 15 and a pair of side frames 16, one of which is removed to show one of the powerful operating springs 17 that biases the operating mechanism by means of upper link 18 and an operating cam 19 which captures a roller 20 at the bottom of the upper link. The cradle 21 restrains the operating mechanism against the bias of the operating springs by engagement between the cradle hook 21A and the operating latch assembly 23. A good description of a similar latch assembly is found within U.S. Pat. No. 4,731,921 which Patent is incorporated herein for purposes of reference. The cradle pivotally connects with the upper link 18 by means of the upper link pivot 24 to hold the operating mechanism and the movable contact arm 27, that connects with the operating mechanism by means of the operating cam 19, in a closed condition wherein the movable contact 29 at the end of the movable contact arm abuts the fixed contact 30 arranged on the fixed contact arm 28. The fixed contact arm is fastened to the bottom case extension 31 by means of a screw 32. The U-shaped configuration of the fixed contact arm 28 and the arrangement of the bottom contact 30 promotes the electrodynamic repulsion of the movable contact arm 27 as described within U.S. Pat. No. 4,086,460, which Patent is incorporated herein for reference purposes. The movable contact arm is fastened to the base 11A of the circuit breaker case 11 by means of a screw 39. An arc chamber 25 suppresses and extinguishes the arc that occurs when the contacts become separated and an integrally-formed interior baffle 26 prevents the arc by-products from interfering with the operating mechanism 14. The movable contact arm 27 is part of the movable contact arm assembly 40 which includes the U-shaped movable contact arm support 37 along with the plunger assembly 33. The movable contact arm is attached to the movable contact arm support by the provision of a pivot pin 36 through the U-shaped end 38 of the movable contact arm support and through the movable contact arm. The pivotal attachment between the movable contact arm and the movable contact arm support allows the movable contact arm to become "blown-open" by means of the electrodynamic repulsion generated between the movable contact arm and the fixed contact arm 28 as described earlier. The arrangement between the cam 19 and the movable contact arm 27 allows the movable contact arm to be moved to the open position upon the automatic release of the cradle hook 21A by the latch assembly 23 as well as by the manual intervention of the operating handle 13. The pivot pin 36 also extends through one end of the plunger assembly arm 35 while the plunger assembly 33 is attached to the circuit breaker crossbar 22 by means of a pair of screws 34, one of which is visible in FIG. 1.

Figure 2:
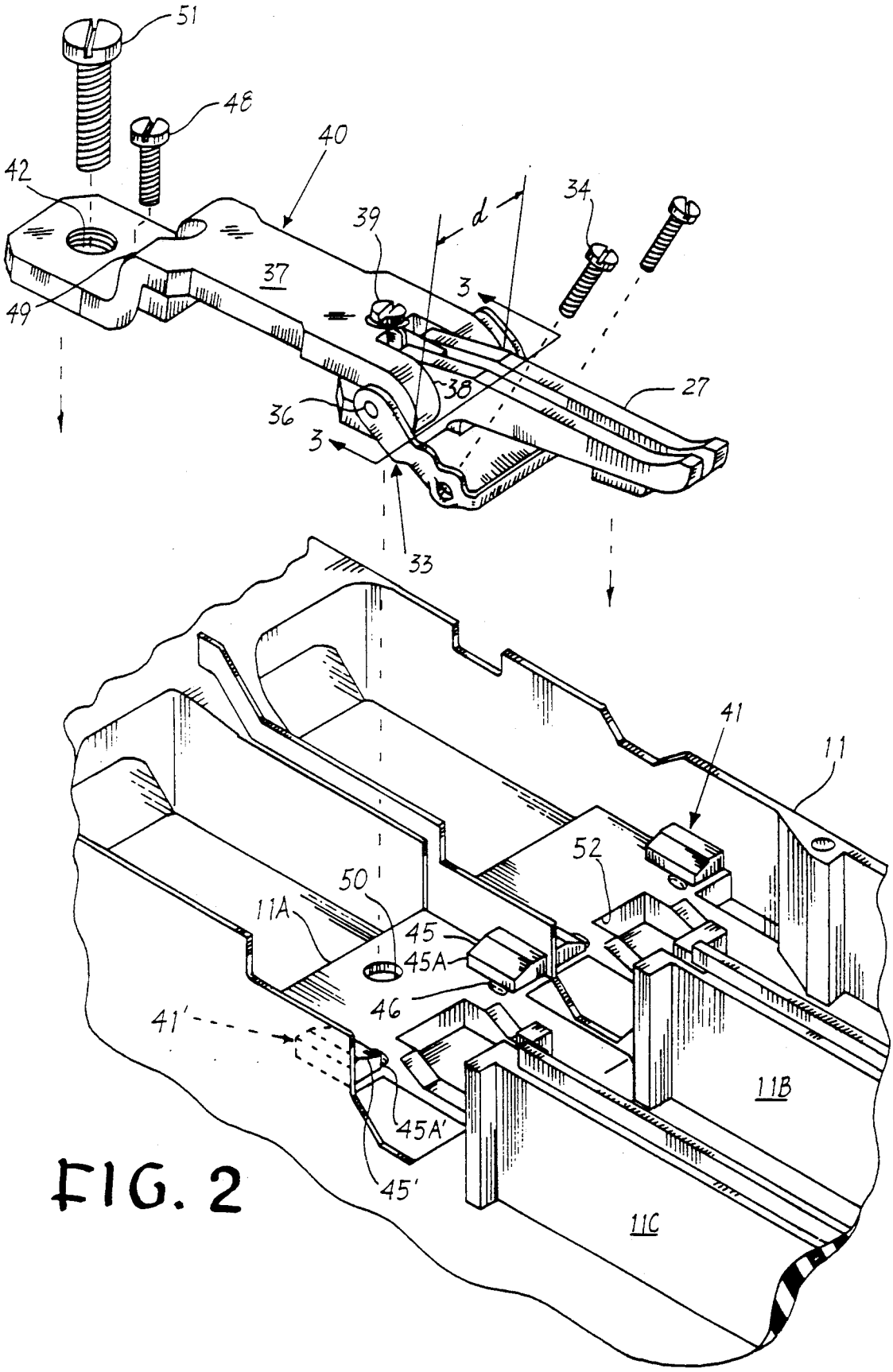
FIG. 2 is a top perspective view in isometric projection of the movable contact arm mounting arrangement depicted in FIG. 1 prior to insertion within the circuit breaker case.

The movable contact arm assembly 40 is shown in FIG. 2 with the plunger assembly 33 positioned over the end of the pivot pin 36 before fastening the assembly to the base 11A of the circuit breaker case 11 by means of screw 39. The arrangement of the pivot pin 36, movable contact arms 27 and U-shaped end 38 form a hinge-like joint which permits the free rotation of the movable contact arms when the plunger assembly 33 is later fastened to the plastic crossbar 22 (FIG. 1) by means of screws 34. To accurately position the entire movable contact arm assembly 40 within the circuit o breaker case 11 a pair of plastic pedestals 41, 41' are formed integral with the case either ahead of or on the interior walls 11B, 11C thereof. The pedestals are provided with a pentagonal configuration such that the sloping front faces 45, 45' taper inwardly away from the sidewalls 11B, 11C and terminate in planar front walls as depicted, for example at 45A. The spacing between the opposing front walls on the pedestals is configured to the outside dimension a of the support 37. A radial depression 46 is defined within the base 11A subjacent each of the front walls 45A, 45A' such that when the movable contact arm assembly 40 is positioned between the pedestals, the outside edges of the support interfere with the sloping front faces and front walls and cuts into the front faces and front walls in an interference-fit relation. The interference-fit automatically compensates for any manufacturing tolerances that accumulate between the components that are in contact with the movable contact arm assembly as well as the components that make up the assembly, per se. It is believed that the compensation for the tolerances results in a uniform mating between the contacts 29, 30 (FIG. 1) resulting in extended life to the contacts. Also, compensation for such tolerances results in reduced friction and binding at the pivot pin 36 when more than one movable contact arm assembly is opened and closed simultaneously by the crossbar during ON-OFF operation of the operating mechanism. The plastic chips that are cut from the front faces and front walls drop into the corresponding radial depressions which are sized to accept the chips in such a manner that the chips do not extend above the base 11A. In the absence of the radial depressions, it is anticipated that the plastic chips would otherwise fall under the support 37 resulting in an uneven or unlevel placement of the support on the base resulting in poor operating mechanism performance, increased pivot pin friction and a possible uneven mating of the surfaces of the contacts 29, 30 (FIG. 1). The support 37 is fastened to the base 11A by means of screw 48, thru-hole 49 and threaded opening 50. The load terminal screw 51 is then attached to the support by means of the threaded opening 42. The tight interference-fit between the edges of the support and the front walls and front faces of the pedestals lockingly holds the support in such a manner that the tightening of the aforementioned screws does not in any way effect the position or alignment of the support within the case. The trough 52 ahead of the threaded opening 50 provides clearance for the movable contact arms as they rotate between their closed and open positions.

Figure 3:
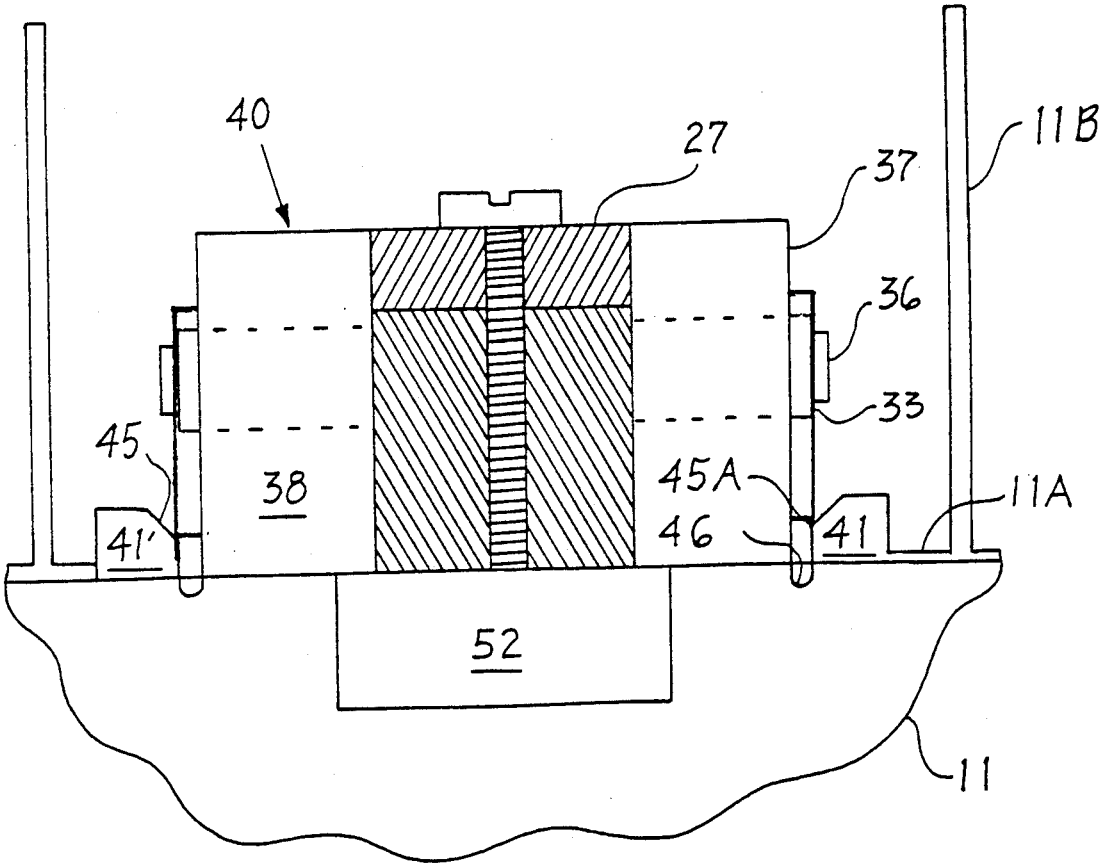
FIG. 3 is a sectional end view of the movable contact arm arrangement of FIG. 2 after attachment within the circuit breaker case.

The movable contact arm assembly 40 is shown attached to the bottom 11A of the circuit breaker case 11 in FIG. 3. The plunger assembly 33 is attached to the pivot pin 36 and the support 37 is positioned over the trough 52 that accommodates the movable contact arms 27. The interference-fit between the U-shaped movable contact arm support 38 is formed between both the front 45 and bottom 45A of the pedestal 41 in the corners of the support, as indicated. As described earlier, the positioning of the radial depressions 46 under the front face collects the plastic chips that are cut from the pedestal when the support is positioned within the case and attached to the base thereof.

It has thus been shown that an interference-fit between the edges of the movable contact arms support prevents movement of the support during the subsequent fastening of the support to the base-part of the circuit breaker case while automatically compensating for any manufacturing tolerances that otherwise accumulate between the movable contact arm support and the sidewalls of the circuit breaker case.

Having thus described our invention, what we claim as new and desire to secure by Letters Patent is:

1. A molded case circuit breaker comprising:

a plastic case and cover;

a movable contact arranged at one end of a movable contact arm, said movable contact arm being pivotally-supported on a support base within said case;

an operating mechanism within said case arranged for moving said contact arm and said movable contact between closed and open positions; and means integrally-formed within said case supporting said support base and said movable contact arm in a press-fit relation with said case, said supporting means comprising a spaced-apart pair of pedestals upstanding from a bottom of said case, said support base defining an outer dimension and said pair of pedestals being spaced apart by a distance less than said outer dimension.

2. The circuit breaker of claim 1 wherein said pedestals comprise a sloping front part facing said support base.

3. The circuit breaker of claim 2 wherein said sloping front part terminates at a bottom part perpendicular to said bottom of said case.

4. The circuit breaker of claim 1 wherein said support base includes a pair of U-shaped ends, said movable contact arm being retained between said U-shaped ends.

5. The circuit breaker of claim 1 including further receptacle means formed within said case inboard said supporting means, said receptacle means being arranged to receive plastic chips cut from said pedestals during insertion of said support base.

6. A method of attaching a movable contact arm assembly to a circuit breaker comprising the steps of:

providing a platic circuit breaker case having a pair of pedestals integrally-formed therein, said pedestals being spaced apart by a predetermined distance;

providing a movable contact arm assembly mounted on a support base having an exterior dimension greater than said predetermined distance;

inserting said support base and said movable contact arm assembly between said pedestals in a press-fit configuration; and providing a trough on a bottom of said pedestals thereby trapping plastic particles cut from said pedestals by said support base.

* * * * *